US011950657B1

(12) United States Patent
Smith

(10) Patent No.: US 11,950,657 B1
(45) **Date of Patent: *Apr. 9, 2024**

(54) CONVERTIBLE FOOTWEAR

(71) Applicant: Camilia Smith, Jacksonville, FL (US)

(72) Inventor: Camilia Smith, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/498,774

(22) Filed: Oct. 31, 2023

Related U.S. Application Data

(63) Continuation of application No. 18/211,250, filed on Jun. 17, 2023, now Pat. No. 11,849,807.

(51) Int. Cl.

| | |
|---|---|
| ***A43B 3/24*** | (2006.01) |
| ***A43B 3/00*** | (2022.01) |
| ***A43B 3/10*** | (2006.01) |
| ***A43B 3/12*** | (2006.01) |

(52) U.S. Cl.
CPC ..... *A43B 3/24* (2013.01); *A43B 3/0031* (2013.01); *A43B 3/10* (2013.01); *A43B 3/12* (2013.01); *A43B 3/248* (2013.01)

(58) Field of Classification Search
CPC .. A43B 3/24; A43B 3/248; A43B 3/12; A43B 3/101; A43B 3/106; A43B 3/124; A43B 3/0031; A43B 3/244; A43B 3/122
USPC ..... 36/11.5
See application file for complete search history.

(56) References Cited

U.S. PATENT DOCUMENTS

| | | | | |
|---|---|---|---|---|
| 2,725,913 A | | 12/1955 | Lewis | |
| 2,738,598 A | * | 3/1956 | Inga | A43B 5/08 36/71 |
| 3,336,683 A | * | 8/1967 | Schellkopf | A43B 3/126 36/58.6 |
| 3,631,613 A | | 1/1972 | Brettell | |
| 4,114,296 A | | 9/1978 | Smith | |
| 5,881,788 A | | 3/1999 | Hersh et al. | |
| 6,526,676 B1 | | 3/2003 | Ledergerber | |
| 6,904,706 B2 | | 6/2005 | Jones et al. | |
| 6,993,858 B2 | | 2/2006 | Seamans | |

(Continued)

FOREIGN PATENT DOCUMENTS

| | | |
|---|---|---|
| CA | 2937474 A1 | 2/2018 |
| GB | 2443937 A | 5/2008 |
| WO | 2008116945 A1 | 10/2008 |

OTHER PUBLICATIONS

360 Pair Disposable Foam Pedicure Slippers Multi Color Flip Flop Salon Nail Spa, https://www.amazon.com/Disposable-Pedicure-Slippers-Multi-Color/dp/B00MTVRJWO Jun. 13, 2023.

(Continued)

*Primary Examiner* — Marie D Bays
(74) *Attorney, Agent, or Firm* — American University, Glushko-Samuelson Intellectual Property Law Clinic

(57) ABSTRACT

A first footwear comprises a first strap and a first fastener. The first strap comprises a first connector affixing the first strap to a foot side of the first footwear; and a first fastener disposed to the first strap. The second fastener is affixed to the first footwear. The first footwear and a second footwear are configured such that: the first footwear and the second footwear can fold together with the first footwear on the outside; and the first strap is repositionable to connect the first fastener to the second fastener.

20 Claims, 5 Drawing Sheets

(56) References Cited

U.S. PATENT DOCUMENTS

| | | | | |
|---|---|---|---|---|
| 7,168,190 | B1 * | 1/2007 | Gillespie | A43B 3/24 363/31 |
| 7,694,435 | B1 * | 4/2010 | Kiser | A43B 3/24 36/11.5 |
| 8,763,275 | B2 * | 7/2014 | Shalom | A43B 3/108 36/102 |
| 8,832,971 | B2 | 9/2014 | Heid | |
| 9,089,184 | B1 * | 7/2015 | Kiser | A43B 3/108 |
| 10,104,931 | B1 | 10/2018 | Krastev | |
| 10,609,982 | B2 | 4/2020 | Velazquez et al. | |
| 2009/0193684 | A1 * | 8/2009 | Diamond | A43B 3/122 36/23 |
| 2009/0249655 | A1 * | 10/2009 | Portnell | A43B 3/0031 36/11.5 |
| 2011/0277345 | A1 * | 11/2011 | Luiz | A43B 3/103 36/11.5 |
| 2013/0025161 | A1 * | 1/2013 | Doran | A43B 1/0027 36/88 |
| 2013/0036630 | A1 * | 2/2013 | Gavrieli | A43B 3/24 36/102 |
| 2014/0102921 | A1 | 4/2014 | Chapuseaux | |
| 2014/0123517 | A1 * | 5/2014 | Chen | A43B 3/248 36/102 |
| 2014/0310992 | A1 * | 10/2014 | Shalom | A43B 3/246 36/103 |
| 2014/0373396 | A1 * | 12/2014 | Chang | A43B 13/141 36/30 R |
| 2015/0157092 | A1 * | 6/2015 | Perez | A43B 3/0094 36/136 |
| 2017/0143071 | A1 * | 5/2017 | Huang | A43B 3/126 |
| 2020/0107605 | A1 * | 4/2020 | Anderson | A43B 3/128 |
| 2020/0390184 | A1 * | 12/2020 | Caulk | A43B 3/248 |
| 2021/0085016 | A1 * | 3/2021 | Caulk | A43B 13/16 |
| 2021/0177086 | A1 * | 6/2021 | Caulk | A43B 3/248 |
| 2022/0071337 | A1 * | 3/2022 | Chehebar | A43B 3/242 |

OTHER PUBLICATIONS

Husmeu Men's Casual Sandals, https://www.amazon.com/Husmeu-Sandals-Leather-Comfort-Support/dp/B0B3HTTQDN Jun. 13, 2023.

Jesus Sandal, https://greek-sandals.com/leather-products/men-sandals/jesus-sandals-mens-sandals-with-toe-loop/ Jun. 13, 2023.

Abra Sandal, https://www.etsy.com/listing/874329814/abra-womens-leather-toe-loop-sandal?ga_order=most_relevant&ga_search_type=all&ga_view_type=gallery&ga_search_query=toe+loop +sandals &ref=sc_gallery-1-7&frs=1&col=1&plkey=bfab9c03c2e4d45bb57e5896526f5b37d9ba5ebf%3A874329814 Jun. 13, 2023.

* cited by examiner

CONVERTIBLE FOOTWEAR

REFERENCE TO RELATED APPLICATIONS

This application is a continuation of U.S. patent application Ser. No. 18/211,250, filed Jun. 17, 2023, which is hereby incorporated in its entirety.

BRIEF DESCRIPTION OF DRAWINGS

Non-limiting examples of embodiments of the disclosure are described below with reference to figures attached hereto that are listed following this paragraph. Similar structures, elements or parts that appear in more than one figure are generally labeled with a similar numeral in other figures in which they appear. Dimensions of components and features shown in the figures are chosen for convenience and clarity of presentation and are not necessarily shown to scale.

DETAILED DESCRIPTION OF THE INVENTION

Figures 1A, 1B:
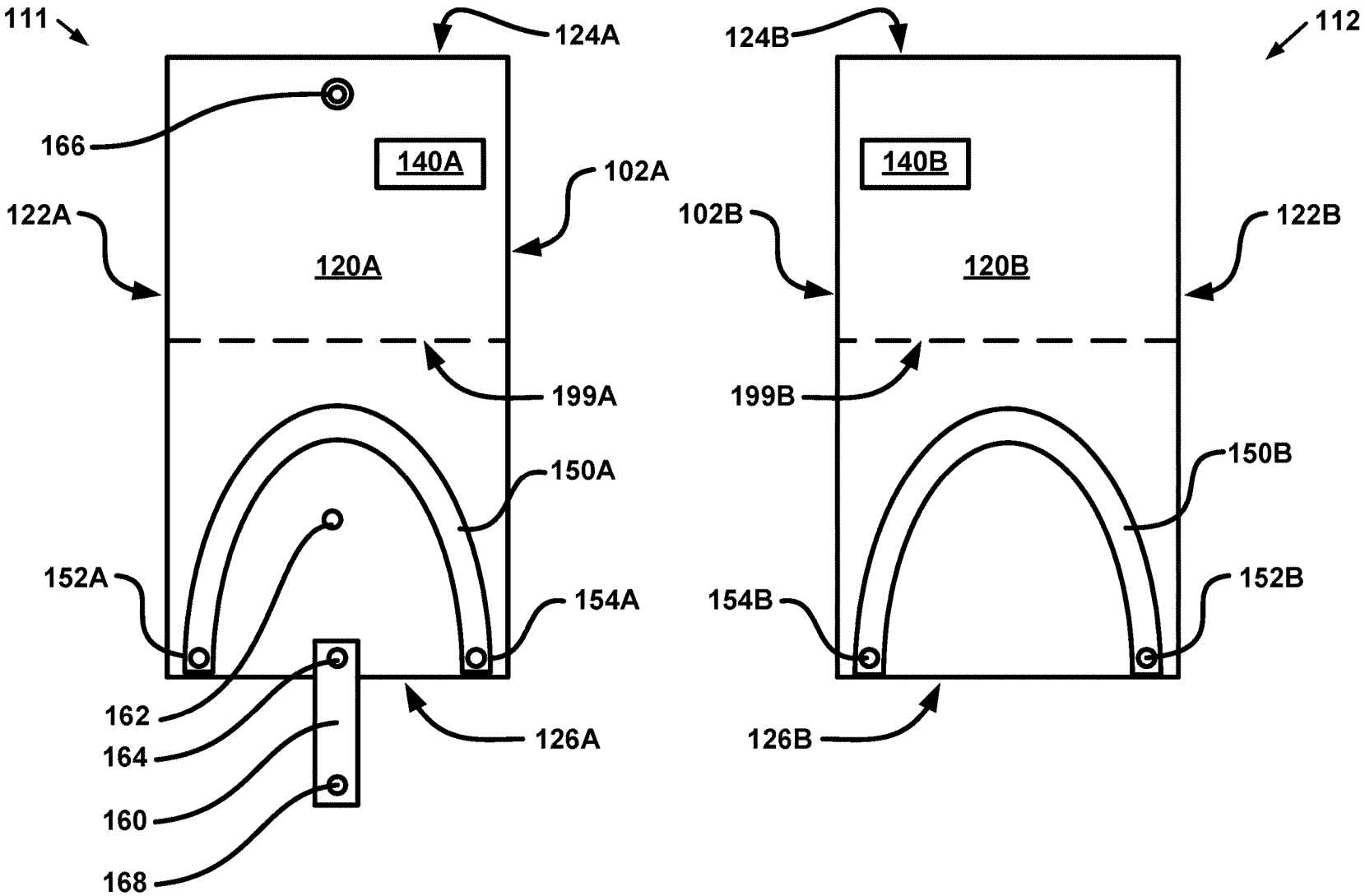
FIG. 1A is an illustration of a top view of a first footwear with the first and second strap turned toward the heel of the first footwear as per an aspect of a disclosed example embodiment.
FIG. 1B is an illustration of a top view of a second footwear first strap turned toward the heel of the second footwear as per an aspect of a disclosed example embodiment.

Example embodiments are generally directed to transformable footwear. Embodiments include footwear that can convert to a carrying mechanism without needing to carry a separate bag. Embodiments also comprise a bag that turns into footwear when a user will no longer wear the footwear they previously had on.

A sandal that converts into a purse is a unique and innovative concept that combines the functionality of a footwear and a bag into one versatile product. This innovation comprises an ability to transform from a comfortable and stylish sandal into a functional purse in a matter of seconds, providing the wearer with a convenient and space-saving solution for carrying essentials. The sandal purse may feature a detachable strap or a foldable design that allows it to be easily converted from a sandal to a purse.

Embodiments allow for the wearer to carry a small bag or purse without having to carry an extra item, making it a convenient and space-saving solution for those who like to travel light. Embodiments would be especially useful in situations where carrying an extra pair of shoes is inconvenient or impractical, such as a formal event or impromptu cocktail hour. The footwear could be worn while walking around or enjoying activities, and then quickly transformed into a purse when needed to carry items such as a credit card, cash, or identification card. The purse component may have multiple compartments for storage, including a zippered pouch for valuables, slots for cards and IDs, and space for other essentials such as a phone, keys, and makeup. Additionally, a sandal that transforms into a purse may be a stylish and versatile accessory that appeals to those who value both fashion and functionality.

This innovative design may appeal to travelers, beach-goers, or anyone who wants to streamline their belongings and avoid carrying a separate bag while out and about. It also adds a fun and playful twist to the traditional sandal design, making it a unique and eye-catching accessory that can be both practical and stylish.

Traditionally, straps have been used to secure a foot to a shoe for improved stability, especially in challenging terrain. In some shoe types, such as clogs, this may be a primary function of the strap. Straps have also been previously used in convertible ways that rotate from securing a foot to a shoe to maintaining a position on the shoe that reduces the support to the foot. However, in some cases, straps may also serve as a fashion statement.

Embodiments have enabled an innovative use of straps in footwear design, such as enabling a shoe to transform into a carry implement for a pair of footwear. This innovation allows individuals to conveniently carry their shoes when it is not practical or comfortable to wear them, making it a practical and stylish solution for those on the go. In such a case, the converted apparatus may be better than a purse because it provides the main footwear a convenient space to sit when dirty or wet without having to employ a separate purse like structure.

This innovative integrated all-in-one embodiment offers a convenient solution to the problem of carrying dirty or wet shoes. The converted apparatus provides a space for the main footwear to sit, without the need for a separate purse-like structure that could, for example, be susceptible to dirt and water damage. This feature adds to the versatility and practicality of the shoe, making it an innovative option as an alternative to a traditional purse for carrying shoes in certain situations.

Certain embodiments of footwear may be configured for disposable use, while also providing protection for the wearer's primary footwear. Such disposable footwear can be a practical solution for activities such as outdoor events or travel, where individuals may need to switch between different types of footwear throughout the day. Other embodiments of footwear may be configured to provide more durability and longevity for longer-term usage. These footwear innovations may add resilience, with features such as reinforced soles and high-quality materials to ensure longevity and comfort for the wearer. In summary, depending on the intended usage and scenario, the disclosed footwear may provide an innovative range of durability and functionality features to meet the specific needs of the wearer.

FIG. 1A is an illustration of a top view of a first footwear 111 with the first strap 150A and second strap 160 turned toward the heel side 126A of the first footwear 111 as per an aspect of a disclosed example embodiment. According to an embodiment, the first footwear 111 may comprise: a ground side (e.g. 328); a foot side 120A; a heel side 126A; a toe side 124A; a medial side 102A; a first fastener 166; a toe loop 140A; a second fastener 162; a third fastener 168; a fold line 199A and a lateral side 122A. According to an embodiment, the first footwear 111 may be a shoe. Footwear is a type of clothing that is worn on the feet. It is configured to provide protection and comfort to the foot while also serving aesthetic, cultural, or social purposes. Footwear can take many forms and styles, ranging from simple sandals to complex athletic shoes or high heels. Footwear may be made from a wide variety of materials, including leather, fabric, rubber, and synthetic materials. The design and construction of footwear can vary depending on its intended purpose, such as athletic footwear configured for specific sports, dress shoes configured for formal occasions, or work boots configured for specific jobs. Footwear serves several functions beyond just providing protection and comfort. It can also make a fashion statement, express cultural identity or affiliation, or provide support or correction for various foot conditions or disorders. Additionally, some footwear may be configured with specific features or materials to address concerns such as durability, slip resistance, or waterproofing. According to an embodiment, the first footwear 111 may be a sandal. According to an embodiment, the first footwear 111 may be a slipper. According to an embodiment, the first footwear 111 may be a swim shoe. According to an embodiment, at least one of the first footwear 111 and the second footwear 112 may comprise rubber. According to an embodiment, at least one of the first footwear 111 and the second footwear 112 may comprise a water resistant material. According to an embodiment, at least one of the first footwear 111 and the second footwear 112 may comprise leather.

According to an embodiment, a sandal may be a type of open-toed footwear that consists of a sole held to the foot by straps, thongs, or other means of attachment. Sandals may be made of various materials such as leather, rubber, or fabric, and can have a variety of designs, from simple flip-flops to more complex strappy styles. Sandals may be worn in warm weather or on beaches, and can be casual or dressy depending on the style and material.

According to an embodiment, a slipper may be a type of comfortable and soft indoor or outdoor footwear that is typically worn inside or outside of the home. Slippers may be configured to be easy to put on and take off, and they are often made of soft and flexible materials such as wool, cotton, or plush. Slippers may cover the entire foot and can have a closed or open toe. Some slippers may also have a rubber or non-slip sole for added traction on smooth indoor surfaces. Slippers may be worn for warmth and comfort, and are often used to protect floors from outdoor dirt and debris.

According to an embodiment, a swim shoe, may be a footwear configured for use in and around water. Swim shoes may be made of lightweight, quick-drying materials that allow them to be worn in the water without becoming waterlogged or heavy. They may have a neoprene upper or mesh panels that provide ventilation and prevent sand and other debris from entering the shoe. Swim shoes may also have a non-slip sole that provides traction on wet and slippery surfaces, making them ideal for activities such as swimming, snorkeling, kayaking, and boating. Swim shoes may be worn on beaches or in other aquatic environments where sharp rocks, shells, or other hazards may be present.

According to an embodiment, a rubber may be a highly elastic and flexible material that is derived from the sap of the rubber tree or other plants. The sap, may also be known as latex. Latex may be collected and processed to produce natural rubber. Alternatively, synthetic rubber may be made by chemically modifying petroleum or other materials. Rubber has a variety of properties that make it useful in many applications, including its ability to stretch and return to its original shape, its durability and resistance to wear, and its ability to insulate against heat and electricity. Rubber may be used in footwear.

According to an embodiment, water-resistant material may be a type of fabric or material that resist the penetration of water to a certain extent but may not be completely waterproof. Water-resistant materials may be treated with a coating or finish that repels water, preventing it from soaking through the material. This coating or finish may be made of various materials such as silicone, polyurethane, or wax, and may be applied to the surface of the material to create a barrier between the water and the underlying fibers. Water-resistant materials may be used in outdoor products, such as bags, shoes, and other accessories. Water-resistant materials may be effective in light rain or splashes of water.

According to an embodiment, leather may be a material that is made from the skin of animals, typically cows, goats, or sheep. The process of making leather may involve treating the raw animal hide with tanning agents to create a durable, flexible, and long-lasting material. Leather may be dyed, embossed, or treated with various finishes to achieve different colors, textures, and levels of water resistance. Leather is known for its durability, strength, and natural beauty, and may be used in a wide range of products, including shoes and handbags. Different types of leather may have different characteristics, such as grain patterns, thickness, and softness, and are suited to different types of products and applications. According to an embodiment, some leather may be synthetic.

According to an embodiment, the first footwear 111 may be configured to: rotate the first strap 150A about the first rotatable connector 152A and/or the second rotatable connector 154A. According to an embodiment, the first footwear 111 may be configured to: rotate the second strap 160 about the third rotatable connector 164. According to an embodiment, the third rotatable connector 164 may be a fixed point on the footwear proximate to the heel side 126A of the footwear. According to an embodiment, the third rotatable connector 164 may be configured to allow the second strap 160 to rotate about its fixed point. According to an embodiment, the third rotatable connector 164 may be a fastener. According to an embodiment, the third rotatable connector 164 may comprise a metal material. According to an embodiment, the third rotatable connector 164 may comprise a plastic material. According to an embodiment, the third rotatable connector 164 may comprise a metal rivet. According to an embodiment, a rivet is a mechanical fastener used to join two or more materials together. A rivet consists of a cylindrical shaft with a head on one end and a tail on the other. The rivet is inserted into a pre-drilled hole and then the tail end is deformed (sometimes by being hammered or compressed) to create a new head, which may lock the materials together. Rivets may be made of materials such as steel, aluminum, copper and/or the like. Rivets are often used when a strong joint is required. Rivets may be used to join materials of different thicknesses or materials that have different properties.

According to an embodiment, the first footwear 111 may comprise a pocket 295. According to an embodiment, the pocket 295 may comprise a flexible material. According to an embodiment, the pocket 295 may comprise a wallet. According to an embodiment, the first footwear 111 may comprise the wallet. A wallet may be a small, flat container used to carry personal items such as cash, credit cards, identification documents, and other small items. Wallets may comprise leather or a similar material. Wallets may be configured to fit comfortably in a pocket or purse. Wallets may hold and/or organize money and cards, and may also include a zipper or snap closure to keep the contents secure. Wallets may be used by all genders to store and organize their personal belongings when they are out and about.

FIG. 16 is an illustration of a top view of a second footwear 112 with the first strap 15013 turned toward the heel side 1266 of the second footwear 112 as per an aspect of a disclosed example embodiment. According to an embodiment, the second footwear 112 may be configured for an opposite foot as the first footwear 111. According to an embodiment, the second footwear 112 may be configured for either a left or right foot. According to an embodiment, the second footwear 112 may be different than the first footwear 111. According to an embodiment, the second footwear may comprise: a foot side 12013; heel side 12613; a lateral side 12213; a toe loop 14013; a medial side 102B; a toe side 1246 and a fold line 1996.

According to an embodiment, the second footwear 112 may further comprise a first strap 15013 configured to: rotate the first strap 15013 about the first rotatable connector 15213; and the second rotatable connector 1546.

Figure 2B:
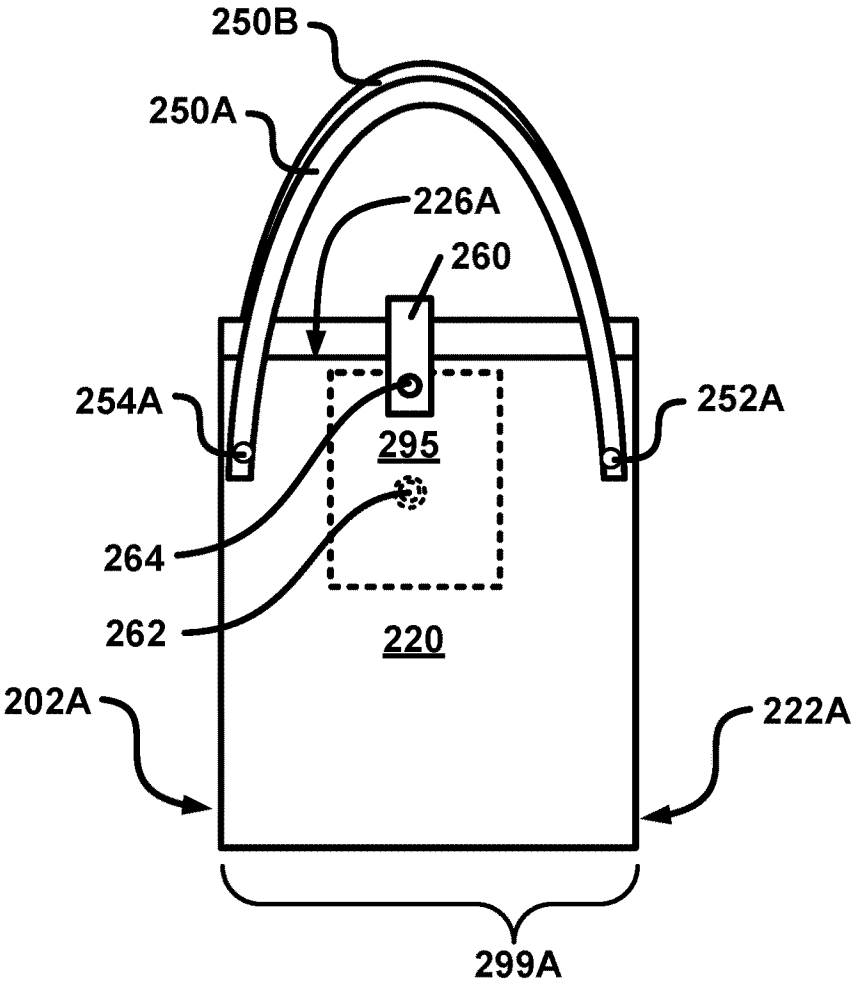
FIG. 2B is an illustration of a top view of the first footwear with the heel portion shown in folded form as per an aspect of a disclosed example embodiment.
Figure 2A:
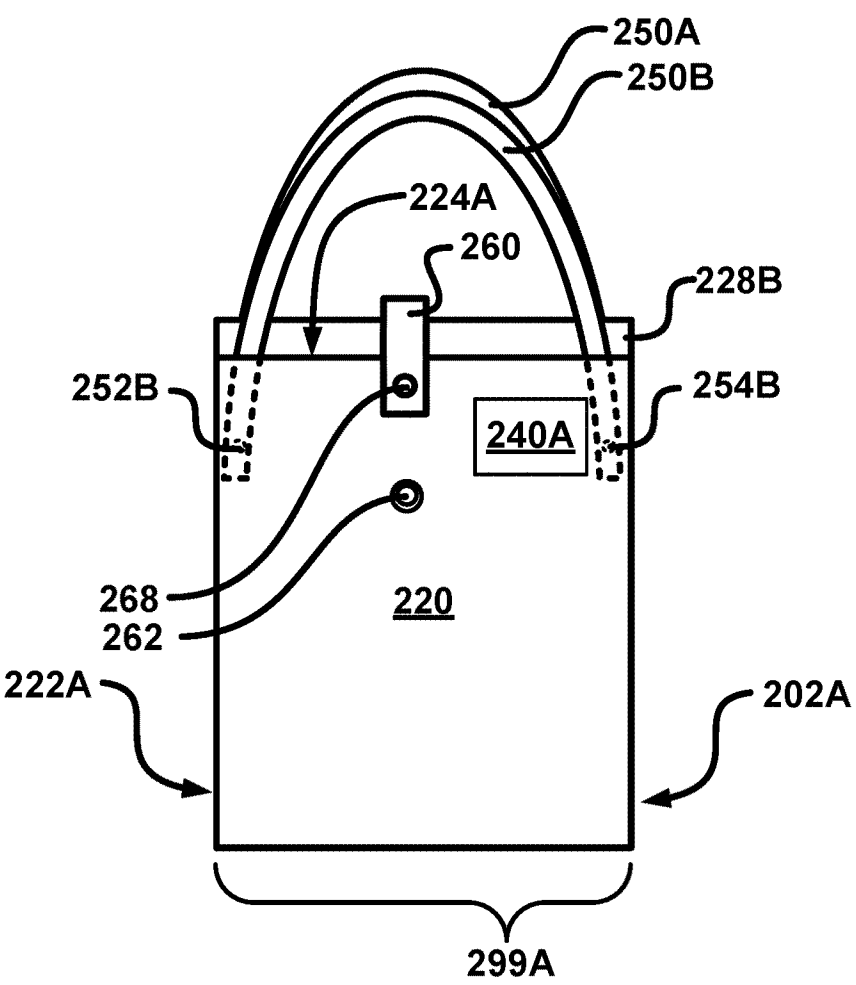
FIG. 2A is an illustration of a top view of a first footwear with a toe portion shown in folded form as per an aspect of a disclosed example embodiment.

FIG. 2A is illustration of a top view of a first footwear (e.g. 111) and a second footwear (e.g. 112) with a toe portion shown in folded form as per an aspect of a disclosed example embodiment. According to an embodiment the first footwear (e.g. 111) may comprise: a foot side 220; a heel side 226A; a toe side 224A; a medial side 202A; a lateral side 222A; a first strap 250A and a toe loop 240A. According to an embodiment, a second footwear (e.g. 112) may comprise a ground side 228B; a first strap 250B; a first rotatable connector 2526 and a second rotatable connector 2546. According to an embodiment the first footwear (e.g. 111) may rotate its first strap 250A about its first rotatable connector 252A and second rotatable connector 254A to orient the first strap 250A away from the heel side 226A. According to an embodiment the second footwear (e.g. 112) may rotate its first strap 250B about its first rotatable connector 252B and second rotatable connector 254B to orient the first strap 250B away from its heel side 226B.

According to an embodiment, the ground side (e.g. 328) of a first footwear (e.g. 111) and the ground side 228B of a second footwear (e.g. 112) may be configured to touch. According to an embodiment, a first footwear (e.g. 111) and a second footwear (e.g. 112) may be folded along a fold line 299A of the first footwear (e.g. 111) so that the heel portion 226A and the toe portion 224A are proximate to one another. According to an embodiment, a second strap 260 may be rotated around a third rotatable connector 264. According to an embodiment, a third fastener 268 attached to the end of a second strap 260 may be connected to a first fastener 266.

FIG. 2B is an illustration of an example of a top view of the first footwear with the heel portion shown in folded form as per an aspect of a disclosed example embodiment. According to an embodiment the first footwear (e.g. 111) may comprise: a foot side 220; a heel side 226A; a medial side 202A; a lateral side 222A; a first strap 250A; a second fastener 262; and a wallet 295. According to an embodiment, a second footwear (e.g. 112) may comprise a ground side 228B; a first strap 250B; a first rotatable connector 252B; and a second rotatable connector 254B. According to an embodiment, first strap 250A may be rotated about its first rotatable connector 252A and second rotatable connector 254A. According to an embodiment, the rotation may continue until the first strap 250A is positioned away from the heel side 226A.

According to an embodiment the second footwear (e.g. 112) may rotate its first strap 250B about its first rotatable connector 252B and second rotatable connector 254B. According to an embodiment, the rotation may continue until the first strap 250B is positioned away from its heel side 226B.

According to an embodiment, the ground side 228A of a first footwear (e.g. 111) and the ground side 228B of a second footwear (e.g. 112) may be configured to touch. According to an embodiment, a first footwear (e.g. 111) and a second footwear (e.g. 112) may be folded along the fold line 299A of the first footwear (e.g. 111) so that the heel portion 226A and the toe portion 224A are proximate to one another. According to an embodiment, a second strap 260 may be rotated around a third rotatable connector 264. According to an embodiment, a third fastener 268 attached to the end of a second strap 260 may be connected to a first fastener 266.

Figure 3:
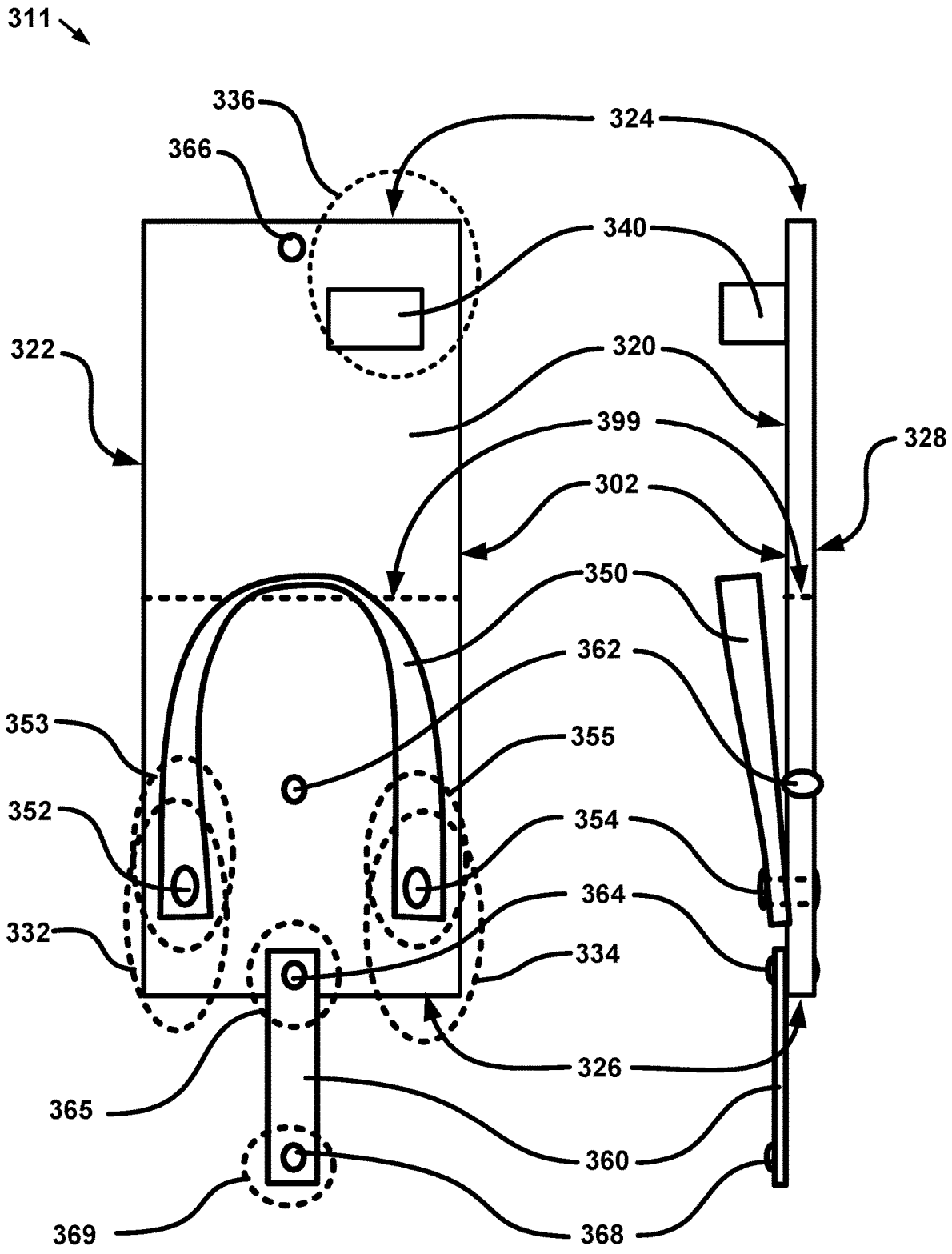
FIG. 3 is an illustration of a top view of a first footwear and a side view of the first footwear as per an aspect of a disclosed example embodiment.

FIG. 3 is an illustration of a top view of a first footwear 311 and a side view of the first footwear 311 as per an aspect of a disclosed example embodiment. According to an embodiment, the first footwear 311 may comprise: a ground side 328; a foot side 320; a heel side 326; a toe side 324; a medial side 302; a toe medial portion 336; a toe loop 340; a medial heel portion 334; a lateral side 322; and a lateral heel portion 332. According to an embodiment, the first footwear 311 may further comprise a first strap 350. According to an embodiment, the first footwear 311 may further comprise a first end portion 353. According to an embodiment, the first footwear 311 may further comprise first rotatable connector 352. According to an embodiment, the first footwear 311 may further comprise a second end portion 355. According to an embodiment, the first footwear 311 may further comprise a second rotatable connector 354. According to an embodiment, the first footwear 311 may further comprise a second strap 360. According to an embodiment, the first footwear 311 may further comprise a third end portion 365. According to an embodiment, the first footwear 311 may further comprise a third rotatable connector 364. According to an embodiment, the first footwear 311 may further comprise a fourth end portion 369. According to an embodiment, the first footwear 311 may further comprise a third fastener 368. According to an embodiment, the first footwear 311 may further comprise a second fastener 362. According to an embodiment, the first footwear 311 may further comprise a first fastener 366. According to an embodiment, a fold line 399 of the first footwear 311 may refer to the line at which the first footwear 311 bends or flexes transforming the first footwear 311 from an unfolded position to a folded position. This line may be located near the centerline perpendicular to the foot.

According to an example embodiment, a ground side of a footwear (e.g. 311) may be configured to be proximate to the ground when in use. The ground side of the footwear (e.g. 311) may refer to the part of the footwear that comes into contact with the ground or surface upon which the wearer is walking or standing. It may also be commonly referred to as the sole of the footwear (e.g. 311). The groundside of the footwear (e.g. 311) may comprise the outsole, which may be the outer layer of the sole that directly contacts the ground, as well as any additional layers or materials that provide cushioning or support between the outsole and the wearer's foot. The configuration and composition of the groundside of the footwear (e.g. 311) may vary depending on the intended use and function of the footwear (e.g. 311), as well as the preferences of the wearer.

According to an embodiment, the ground side 328 may be configured to contact the ground when worn as footwear. According to an embodiment, the ground side 328 may be opposite the foot side 320 and configured not to touch the foot.

According to an embodiment, a foot side 320 may be the portion of the footwear (e.g. 311) that is configured to be proximate to the foot when in use. According to an embodiment, a foot side 320 may be the portion of the footwear (e.g. 311) that is configured to touch the user's foot when worn as footwear. According to an embodiment, a foot side 320 may be the portion of the footwear (e.g. 311) that is opposite the groundside 328 and configured not to touch the ground.

According to an embodiment, the heel side 326 of a footwear (e.g. 311) may be a portion of the footwear (e.g. 311) that includes and immediately surrounds where a heel of a foot of a wearer comes in contact with the footwear (e.g. 311) when the wearer is walking or standing. According to an embodiment, the heel side 326 may extend outward towards the outside of the footwear (e.g. 311). According to an embodiment, the heel side 326 may include a portion of the ground side 328 opposite the footside portion of the footwear (e.g. 311) that includes and immediately surrounds where a heel of a foot of a wearer comes in contact with the footwear (e.g. 311) when the wearer is walking or standing. According to an embodiment, the heel side 326 may be the portion of the footwear (e.g. 311) that is configured to be proximate to the heel of a foot when in use. According to an embodiment, the heel side 326 may be the portion of the footwear (e.g. 311) that is configured to be proximate to the rear of the footwear (e.g. 311). According to an embodiment, the heel side 326 may be the portion of the footwear (e.g. 311) that is configured to be proximate and between the first connector 352 and the second connector 354.

According to an embodiment, the toe side 324 of a footwear (e.g. 311) may refer to the front part of the footwear (e.g. 311) that is closest to the toes of the wearer. According to an embodiment, the toe side 324 may be located on the foot side 320 of the footwear (e.g. 311), opposite the heel area. According to an embodiment, the toe side 324 of the footwear (e.g. 311) may include a toe loop 340, a toe box, and/or the like, which may be the part of the footwear (e.g. 311) that surrounds at least one part of at least one toe. The configuration and construction of the toe side 324 of the footwear (e.g. 311) may vary depending on the intended use and style of the footwear (e.g. 311). The toe side 324 of the footwear (e.g. 311) may also include additional features such as ventilation or reinforcement materials for added durability. According to an embodiment, the toe side 324 may be the portion of the footwear (e.g. 311) that is configured to be proximate to the toe of a foot when in use. According to an embodiment, the toe side 324 may be the portion of the footwear (e.g. 311) that is configured to be proximate to the front of the footwear (e.g. 311). According to an embodiment, the toe side 324 may be the portion of the footwear (e.g. 311) that is configured to be proximate to the forward part of a foot.

According to an embodiment, the medial side 302 may be the portion of a footwear (e.g. 311) that is configured to be proximate to the medial side of a foot when in use. According to an embodiment, the medial side 302 may be a portion of the footwear (e.g. 311) that is configured to be proximate to the inside of the foot when in use. According to an embodiment, the medial side 302 may be configured to be the side closest to the center line of the wearer's body.

According to an embodiment, a toe medial portion 336 may be proximate to: the toe side 324; and the medial side 302. According to an embodiment the toe medial portion 336 of a footwear (e.g. 311) may refer to the inner side of the front part of the footwear (e.g. 311), which may be located on the side of the foot closest to the midline of the body. According to an embodiment, a toe medial portion 336 may be the part of the footwear (e.g. 311) that covers the big toe and the adjacent toes. The toe medial portion 336 of the footwear (e.g. 311) may be configured to provide comfort and support to the toes and help maintain the proper alignment of the foot. According to an embodiment, the toe medial portion 336 may be the portion of the footwear (e.g. 311) that is configured to be proximate to a medial portion of a foot and the toe portion of the foot when in use. According to an embodiment, the toe medial portion 336 may be the portion of the footwear (e.g. 311) that is situated near the median plane of the footwear (e.g. 311). According to an embodiment, the toe medial portion 336 may be the portion of at least one of the first footwear and second footwear that is adjacent to: the medial side 302 and the toe side 324.

According to an embodiment, a toe loop 340 is a design feature of a footwear that may go between the big toe and second toe to help keep the sandal securely in place on the foot. The toe loop 340 may be made of a material, such as leather, fabric, or plastic, that is attached to the sole of the footwear and fits snugly between the toes. The toe loop 340 may be configured to prevent the footwear (e.g. 311) from slipping off the foot while walking, and to provide additional stability and support to the foot. A toe loop 340 is commonly found on flip-flop style sandals, but may also be present on other types of sandals or footwear. The toe loop 340 design is popular among people who enjoy the comfort and freedom of wearing sandals but want a more secure fit than what is offered by traditional slip-on styles. According to an embodiment, a toe loop 340 may be located on the toe medial portion of the footwear (e.g. 311). According to an embodiment, the toe loop 340 may be affixed to the foot side 320 of the toe medial portion 336. According to an embodiment, the toe loop 340 may be affixed to the ground side 328 of the toe medial portion 336. According to an embodiment, the toe loop 340 may be configured to surround a toe when footwear (e.g. 311) is in use. According to an embodiment, the toe loop (e.g. 140A,1406) may be configured to be proximate to the toe medial portion 336 of the first footwear (e.g. 311) and second footwear (e.g. 112) and the medial side (e.g. 302) of the first footwear (e.g. 311) and the medial side (e.g. 102B) of the second footwear (e.g. 112).

According to an embodiment, a first footwear 311 may comprise a medial heel portion 334. The medial side 302 of the first footwear 311 may be the inner side of the first footwear 311, which is located towards the midline of a body. The term "medial" may refer to an area towards the middle of the body. It is the part of the footwear that is on the same side as the big toe. The medial part of a footwear (e.g. 311) can also vary in configuration depending on the type of footwear, but it may provide support and stability for the foot's arch and helps maintain proper alignment of the foot and ankle. In some footwear, the medial part may have additional cushioning or support features to provide more comfort and prevent injuries such as plantar fasciitis or overpronation. According to an embodiment, a medial heel portion 334 may be proximate to the heel side 326 and the medial side 302. According to an embodiment, the medial heel portion 334 may be the portion of at least one of the first footwear 311 and a second footwear (i.e. 112) that may be configured to be proximate to a medial portion of a foot when in use. According to an embodiment, the medial heel portion 334 is a portion of at least one of the first footwear 311 and a second footwear (i.e. 112) may be situated between the heel side 326 and the medial side 302. According to an embodiment, the medial heel portion 334 is a portion of at least one the first footwear 311 and a second footwear (i.e. 112) may be configured to be proximate to the medial side 302 of the footwear (e.g. 311) and proximate to the heel side 326 of the footwear (e.g. 311).

According to an embodiment, the lateral side 322 of a footwear (e.g. 311) may be the outer side of the footwear (e.g. 311), which may be located away from the midline of the body. Lateral may be defined as away from the middle of the body. The lateral side 322 of the footwear (e.g. 311) may vary in design depending on the type of footwear, but it is generally the part of the footwear (e.g. 311) that is on the same side as the little toe. In some sports or activities, such as basketball or tennis, the lateral side 322 of the footwear (e.g. 311) may be reinforced with additional materials or cushioning to provide extra support and stability during sudden lateral movements. According to an embodiment, the lateral side 322 may be the portion of the footwear (e.g. 311) that is configured to be proximate to a lateral side 322 of a foot when in use. According to an embodiment, the lateral side 322 may be configured to be away from the inside of the foot when in use. According to an embodiment, the lateral side 322 may be configured to run from the back of the heel of a foot to the front of the big toe of a foot, away from the middle of the body.

According to an embodiment, a lateral heel portion 332 may be proximate to the heel side 326 and the lateral side 322. According to an embodiment, the lateral heel portion 332 of a footwear (e.g. 311) may refer to the outer side of the heel area, which is located on the side of the foot farthest from the midline of the body. The lateral heel portion 332 may be the part of the footwear (e.g. 311) that comes into contact with the wearer's foot when in a standing position or during walking or running. The lateral heel portion 332 may be an important part of footwear (e.g. 311) that can affect the overall comfort, fit, and performance of the footwear (e.g. 311). According to an embodiment, the lateral heel portion 332 may be the portion of the footwear (e.g. 311) that is configured to be proximate to a lateral portion of a foot when in use. According to an embodiment, the lateral heel portion 332 may be the portion of the footwear (e.g. 311) that is situated near the lateral plane of the footwear (e.g. 311).

According to an embodiment, the first strap 350 may be configured to keep the foot in place and provide additional support and stability to footwear (e.g. 311). According to an embodiment, the first strap 350 may be made of various materials, such as leather, synthetic fabrics, or elastic. According to an embodiment, the first strap 350 may have a buckle, Velcro, or other fastening mechanism for adjusting the fit of the footwear (e.g. 311). According to an embodiment, the design of the first strap 350 may vary greatly depending on the style and purpose of the footwear (e.g. 311), from thin and minimalistic to thicker and more substantial. The first strap 350 may provide comfort, prevent slipping, and enhance the overall appearance of the footwear (e.g. 311). According to an embodiment, the first strap 350 may comprise material substantially similar to the footwear (e.g. 311) material. According to an embodiment, the first strap 350 may comprise a fabric material different from the footwear (e.g. 311) material. According to an embodiment, the first strap 350 may comprise a leather material. According to an embodiment, the first strap 350 may comprise water resistant material. According to an embodiment, the first strap 350 may comprise a material that maintains its shape before rotation. According to an embodiment, the first strap 350 comprises a material that maintains its shape after rotation. According to an embodiment, a first strap 350 may comprise: a first end portion 353 of the first strap 350.

According to an embodiment, the first end portion 353 of the first strap 350 may be affixed to the lateral heel portion 332 with a first rotatable connector 352. According to an embodiment, the first end portion 353 of footwear (e.g. 311) may be the portion of the first strap 350 that is proximate to the first rotatable connector 352. According to an embodiment, the first end portion 353 of the footwear (e.g. 311) may be the portion of the first strap 350 that is proximate to: the first rotatable connector 352 and the lateral side 322 of the footwear (e.g. 311).

A rotatable connector (e.g., the first rotatable connector 152 and/or the second rotatable connector 154) on a footwear is a type of mechanism that allows a strap (or other similar component) to rotate or pivot around a specific axis. This connector is typically located at the point where the strap attaches to the footwear. The rotatable connector may allow for greater flexibility and mobility in the foot. The rotatable connector may be a separate component that is attached to the shoe or it may be built directly into the shoe design. According to some embodiments, the rotatable connector may comprise a ball or socket joint that may allow for rotational movement in one or more directions, depending on the specific design. According to some embodiments, the rotatable connector may comprise a rivet that may allow for rotational movement in one or more directions, depending on the specific design. A rotatable connector on a footwear can provide stability, balance, and/or a natural gait. It can also help reduce the risk of injury by allowing the foot to move more freely and naturally during physical activity. Rotatable connectors are often used in athletic shoes, sandals, and or the like, and they can also be found in other types of footwear, such as work boots or hiking shoes.

According to an embodiment, the first footwear 311 may comprise a first rotatable connector 352. According to an embodiment, the first rotatable connector 352 may be proximate to the lateral side 322 of the footwear. According to an embodiment, the first rotatable connector 352 may be configured to allow the first strap 350 to rotate about the first rotatable connector 352. According to an embodiment, the first rotatable connector 352 may be a rivet. According to an embodiment, the first rotatable connector 352 may comprise metal. According to an embodiment, the first rotatable connector 352 may comprise plastic. According to an embodiment, the first rotatable connector 352 may comprise a metal rivet. According to an embodiment, the first rotatable connector 352 may wherein the first rotatable connector 152 comprise a plastic rivet.

According to an embodiment, the second end portion 355 of the footwear may be the portion of the first strap 350 that is proximate to the second rotatable connector 354. According to an embodiment, the second end portion 355 of the footwear may be the portion of the first strap 350 that is proximate to: the second rotatable connector 354 and the medial side 302 of the footwear.

According to an embodiment, a second end portion 355 of the first strap 350, may be affixed to the medial heel portion 334 with a second rotatable connector 354. According to an embodiment, a second rotatable connector 354 may be the portion of the footwear that is configured to allow the first strap 350 to rotate about its fixed point. According to an embodiment, a second rotatable connector 354 may be a fastener. According to an embodiment, a second rotatable connector 354 may be comprised of a metal. According to an embodiment, a second rotatable connector 354 may be comprised of a plastic material. According to an embodiment, a second rotatable connector 354 may be comprised of a metal rivet. According to an embodiment, a second rotatable connector 354 may be comprised of a plastic rivet. According to an embodiment, at least one of the first rotatable connector 352 and the second rotatable connector 354 may comprise of a metal material. According to an embodiment, at least one of the first rotatable connector 352 and the second rotatable connector 354 may comprise plastic material.

According to an embodiment, a first footwear (e.g. 112) may further comprise a second strap 360. According to an embodiment, the second strap 360 on a footwear (e.g. 311) may be a band or strip of material that is configured to secure the heel portion to the toe portion when the footwear is in a folded form. According to an embodiment, the second strap 360 may also be oriented to be fastened to the second fastener 362. According to an embodiment, the second strap 360 may also be oriented to be unfastened on the second fastener 362. According to an embodiment, the second strap 360 may comprise various materials. According to an embodiment, the second strap 360 may be comprised of a water-resistant material. According to an embodiment, the second strap 360 may comprise a fabric material. According to an embodiment, the second strap 360 may comprise malleable material. According to an embodiment, the second strap 360 may be configured to be flexible. According to an embodiment, the second strap 360 may comprise leather. According to an embodiment, the second strap 360 may comprise plastic. According to an embodiment, the second strap 360 may be located on different parts of a footwear, such as the toe, medial side or lateral side, depending on the design of the footwear. According to an embodiment, the second strap 360 may be proximate to the heel side 326. The second strap 360 located on different parts of a footwear may serve to provide added security to the purse. The second strap 360 located on some of the different parts of a footwear may prevent the contents from falling out or being accessed by others. According to an embodiment, the second strap 360 may comprise: a third end portion 365 of the second strap 360. According to an embodiment, the second strap 360 may be configured to rotate about the third rotatable connector 364. According to an embodiment, the second strap 360 may comprise: fourth end portion 369 of the second strap 360.

According to an embodiment, the third end portion 365 of the footwear may be the portion where the second strap 360 may be configured to be proximate to the third rotatable connector 364. According to an embodiment, the third end portion 365 of the footwear may be the portion of the footwear where the second strap 360 that is configured to be proximate to the first rotatable connector 352 and proximate to the heel side 326 of the footwear.

According to an embodiment, there is a third rotatable connector 364 affixing the third end portion 365 to the foot side 320 of the footwear 311.

According to an embodiment, the fourth end portion 369 of the footwear may be the portion of the second strap 360 that may be configured to contain the third fastener 368 on the portion of the strap furthest from the third rotatable connector 364. According to an embodiment, the fourth end portion 369 of the footwear may be the portion of the second strap 360 that may be configured to be furthest from the third rotatable connector 364.

According to an embodiment, a fastener on a footwear refers to any type of closure mechanism that is used to secure one part of the shoe to another i.e. secure the second strap (i.e. 260) onto the first fastener (i.e. 166) when in the folded position. According to an embodiment, fasteners footwear may comprise lace(s). According to an embodiment, fasteners may comprise zipper(s). According to an embodiment, fasteners may comprise buckle(s).

According to an embodiment, fasteners may comprise Velcro strap(s). According to an embodiment, fasteners may comprise snap(s). A purpose of a footwear fastener may be to keep at least a portion of a footwear securely in place. Different types of fasteners are often used on different types of footwears, depending on the style, function, and intended use of the footwear.

According to an embodiment, a third fastener 368 may be affixed to the fourth end portion. According to an embodiment, the third fastener 368 may be configured to be on the second strap 360 of the footwear. According to an embodiment, the third fastener 368 may be a fixed point on the second strap 360 that is furthest from the heel side 326 of the footwear. According to an embodiment, the third fastener 368 may be configured to affix two or more objects together. According to an embodiment, the third fastener 368 may be configured to connect to the first fastener 366. According to an embodiment, the apparatus may be configured to retain a folded state when the third fastener 368 is connected to the first fastener 366. According to an embodiment, the third faster 368 and first fastener 366 may comprise snaps. According to an embodiment, the third faster 368 and first fastener 366 may comprise hook & loop fasteners. (Velcro™).

According to an embodiment, Velcro is a brand name for a type of fastener that may consist of two strips of material, one covered in tiny hooks and the other covered in tiny loops. When pressed together, the hooks may catch on the loops, creating a secure closure. Velcro fasteners are commonly used in shoes, and bags, to open and close them without the need for buttons, zippers, or laces.

According to an embodiment, the third fastener 368 may comprise a snap. According to an embodiment, the third fastener 368 may comprise Velcro.

According to an embodiment, the second fastener may be fastened using different mechanisms, such as snaps, buckles, zippers, or magnets, and/or the like.

According to an embodiment, a first fastener 366 may be affixed to the footwear 311. According to an embodiment, the first fastener 366 may be affixed to the toe side 324. According to an embodiment, the first fastener 366 may be affixed to the foot side 320. According to an embodiment, the first fastener 366 may be affixed to the medial side 302. According to an embodiment, the first fastener 366 may be affixed to the ground side 120. According to an embodiment, the first fastener 366 of the footwear may affix two or more objects together. According to an embodiment, the first fastener 366 may be affixed the third fastener 368 to the footwear. According to an embodiment, the first fastener 366 may be configured to be a fixed point on the toe side 324 of the footwear. According to an embodiment, the first fastener 366 may comprise a snap. According to an embodiment, the first fastener 366 may comprise Velcro.

According to an embodiment, the first footwear and the second footwear may be configured to: rotate the first strap 350 about: the first rotatable connector 352; and the second rotatable connector 354. According to an embodiment, the ground side 328 of the first footwear 311 may be placed next to a ground side 328 of the second footwear 311. According to an embodiment, the first footwear 311 and the second footwear 311 may be folded such that the second footwear 311 is on the inside of the folded first footwear and folded second footwear. According to an embodiment, the first footwear may be configured to: rotate a second strap 360 about the third rotatable connector 364. According to an embodiment, the third fastener 368 may be connected to the first fastener 366.

Figures 4A, 4B, 4C, 4D:
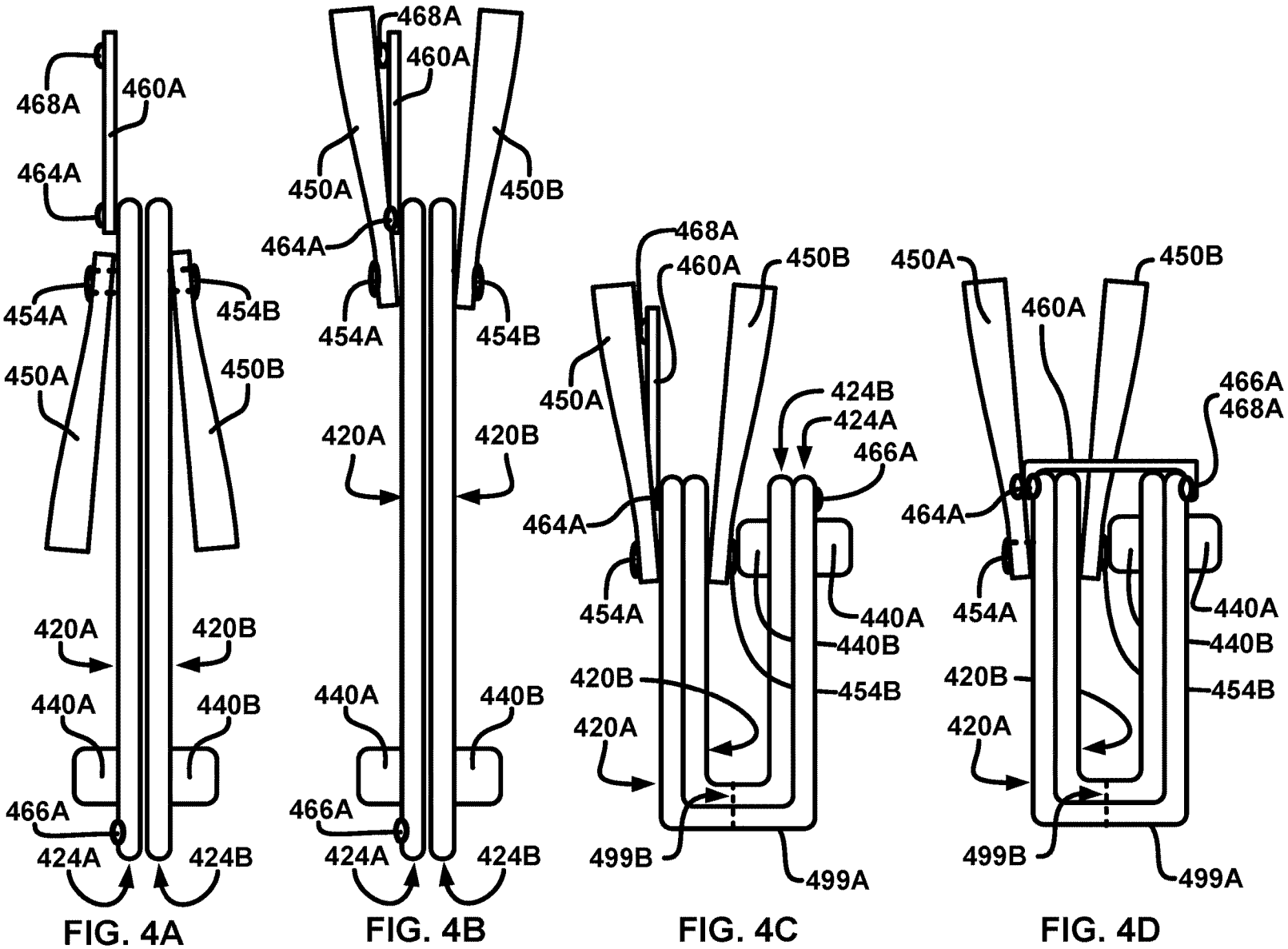
FIG. 4A is an illustration of a side view of a first footwear and a second footwear where the ground sides of the footwear are touching, and the second strap is rotated in the direction of the heel portion of the first footwear as per an aspect of a disclosed example embodiment.
FIG. 4B is an illustration of a side view for the first footwear and the second footwear where the ground side of the footwear are touching, and the first and second strap are rotated in the direction of the heel portion of the footwear as per an aspect of a disclosed example embodiment.
FIG. 4C is an illustration of a side view of the first footwear and the second footwear in the folded position without the second strap fastened as per an aspect of a disclosed example embodiment.
FIG. 4D is an illustration of a side view of the first footwear and second footwear in the folded position with the second strap fastened as per an aspect of a disclosed example embodiment.

FIG. 4A is an illustration of a side view of a first footwear (e.g. 111) and a second footwear (e.g. 112). The ground side (e.g. 328) of a first footwear (e.g. 111) may be configured to touch the ground side of a second footwear (e.g. 112). According to an embodiment, a first footwear (e.g. 111) may comprise a first strap 450A; second strap 460A; a foot side 420A; a toe loop 440A; a first fastener 466A; a third fastener 468A; a second rotatable connector 454A; a toe side 424A; a third rotatable connector 464A and a first rotatable connector (e.g. 352, 152A). According to an embodiment, a second footwear (e.g. 112) may comprise a foot side 420B; a toe loop 440B; a toe side 424B; a first strap 450B and a second rotatable connector 454B.

According to an embodiment, the second strap 460A may rotate about the third rotatable connector 464A.

FIG. 4B is an illustration of an example of a side view for the first footwear (e.g. 111) and the second footwear (e.g. 112) where the ground side (e.g. 328A) of the first footwear (e.g. 111) and the ground side of the second footwear (e.g. 112) are touching. According to an embodiment the first strap 450A of the first footwear (e.g. 111) and the first strap 450B of the second footwear (e.g. 112) may be rotated in the direction of the heel portion (e.g. 126A and 126B) of the footwear.

According to an embodiment, a first footwear (e.g. 111) may comprise a first strap 450A; second strap 460A; a foot side 420A; a toe loop 440A; a first fastener 466A; a third fastener 468A; a second rotatable connector 454A; a toe side 424A; a third rotatable connector 464A and a first rotatable connector (e.g. 352, 152A). According to an embodiment, a second footwear (e.g. 112) may comprise a foot side 420A; a toe loop 440B; a toe side 424B; a first strap 450B and a second rotatable connector 4546. According to an embodiment, the first strap 460A may rotate about the third rotatable connector 464A.

According to an embodiment, the first strap 450A of the first footwear (e.g. 111) may rotate about the first rotatable connector (e.g. 352, 152A) and the second rotatable connector 454A so that the first strap 450A is pointed in the direction of the heel side (e.g. 326, 226A, 126A). According to an embodiment, the first strap 450B of the second footwear (e.g. 112) may rotate about the first rotatable connector (e.g. 1526, 2526) and the second rotatable connected 4546 so that the first strap 450B is pointed in the direction of the heel side (e.g. 1266).

FIG. 4C is an illustration of a side view for the first footwear (e.g. 111) and the second footwear (e.g. 111) in the folded position along the fold line 499A of the first footwear (e.g. 111) and the fold line 4996 of the second footwear (e.g. 112) without the second strap 460A being fastened to the first fastener 466A.

According to an embodiment, a first footwear (e.g. 111) may comprise a first strap 450A; second strap 460A; a foot side 420A; a toe loop 440A; a first fastener 466A; a third fastener 468A; a second rotatable connector 454A; a toe side 424A; a third rotatable connector 464A and a first rotatable connector (e.g. 352, 152A). According to an embodiment, a second footwear (e.g. 112) may comprise a foot side 420A; a toe loop 440B; a toe side 424B; a first strap 450B and a second rotatable connector 4546. According to an embodiment, the first strap 460A may rotate about the third rotatable connector 464A.

According to an embodiment, the first footwear (e.g. 111) and the second footwear (e.g. 112) may be configured where the ground side (e.g. 328A) of the first footwear (e.g. 111) and the ground side (e.g. 3286) of the second footwear (e.g. 112) are touching. Further, according to an embodiment the first strap 450A of the first footwear (e.g. 111) and the first strap 450B of the second footwear (e.g. 112) may be rotated in the direction of the heel portion (e.g. 126A and 126B) of the footwear. According to an embodiment, the second strap 460A may rotate about the third rotatable connector 464A. According to an embodiment, the first footwear (e.g. 111) and the second footwear (e.g. 112) may be folded along the fold line 499A of the first footwear (e.g. 111) and the fold line 4996 of the second footwear (e.g. 112) to configure the footwear in a way that positions the toe sides 424A, 4246 proximate to the heel sides (e.g. 126A, 126B).

FIG. 4D is an illustration of a side view for the first footwear (e.g. 111) and the second footwear (e.g. 112) in the folded position along the fold line 499A of the first footwear (e.g. 111) and the fold line 4998 of the second footwear (e.g. 112) where the second strap 460A is being fastened to the first fastener 466A by the third fastener 468A.

According to an embodiment, a first footwear (e.g. 111) may comprise a first strap 450A; second strap 460A; a foot side 420A; a toe loop 440A; a first fastener 466A; a third fastener 468A; a second rotatable connector 454A; a toe side 424A; a third rotatable connector 464A and a first rotatable connector (e.g. 352, 152A). According to an embodiment, a second footwear (e.g. 112) may comprise a foot side 420A; a toe loop 440B; a toe side 424B; a first strap 450B and a second rotatable connector 4548. According to an embodiment, the first strap 460A may rotate about the third rotatable connector 464A.

According to an embodiment, the first footwear (e.g. 111) and the second footwear (e.g. 112) may be configured where the ground side (e.g. 328A) of the first footwear (e.g. 111) and the ground side of the second footwear (e.g. 112) are touching. Further, according to an embodiment the first strap 450A of the first footwear (e.g. 111) and the first strap 450B of the second footwear (e.g. 112) may be rotated in the direction of the heel portion (e.g. 126A and 126B) of the footwear. According to an embodiment, the second strap 460A may rotate about the third rotatable connector 464A. According to an embodiment, the first footwear (e.g. 111) and the second footwear (e.g. 112) may be folded along the fold line 499A of the first footwear (e.g. 111) and the fold line 4998 of the second footwear (e.g. 112) to configure the footwear in a way that positions the toe sides 424A, 4248 proximate to the heel sides (e.g. 126A, 126B).

According to an embodiment, the third fastener 468A on the second strap 460A may be configured to fasten on the first fastener 466A.

According to an embodiment, an apparatus comprising a first footwear 111 and a second footwear 112 may be configured to disconnect the third fastener 168 from the first fastener 166. According to an embodiment, the first footwear 111 and the second footwear 112 may be configured to be unfolded. According to an embodiment, the first footwear 111 may be separated from the second footwear 112. According to an embodiment, the second strap 160 may be rotated about the third rotatable connector 164. According to an embodiment, the third fastener 168 may connect to the second fastener 162. According to an embodiment, on each of the first footwear and the second footwear, the first strap 150 may be rotated about the first rotatable connector 152 and the second rotatable connector 154. According to an embodiment, the apparatus may be configured with forces sufficient to maintain the position of the first strap at least before or after rotation.

Figures 5A, 5B, 5C, 5D:
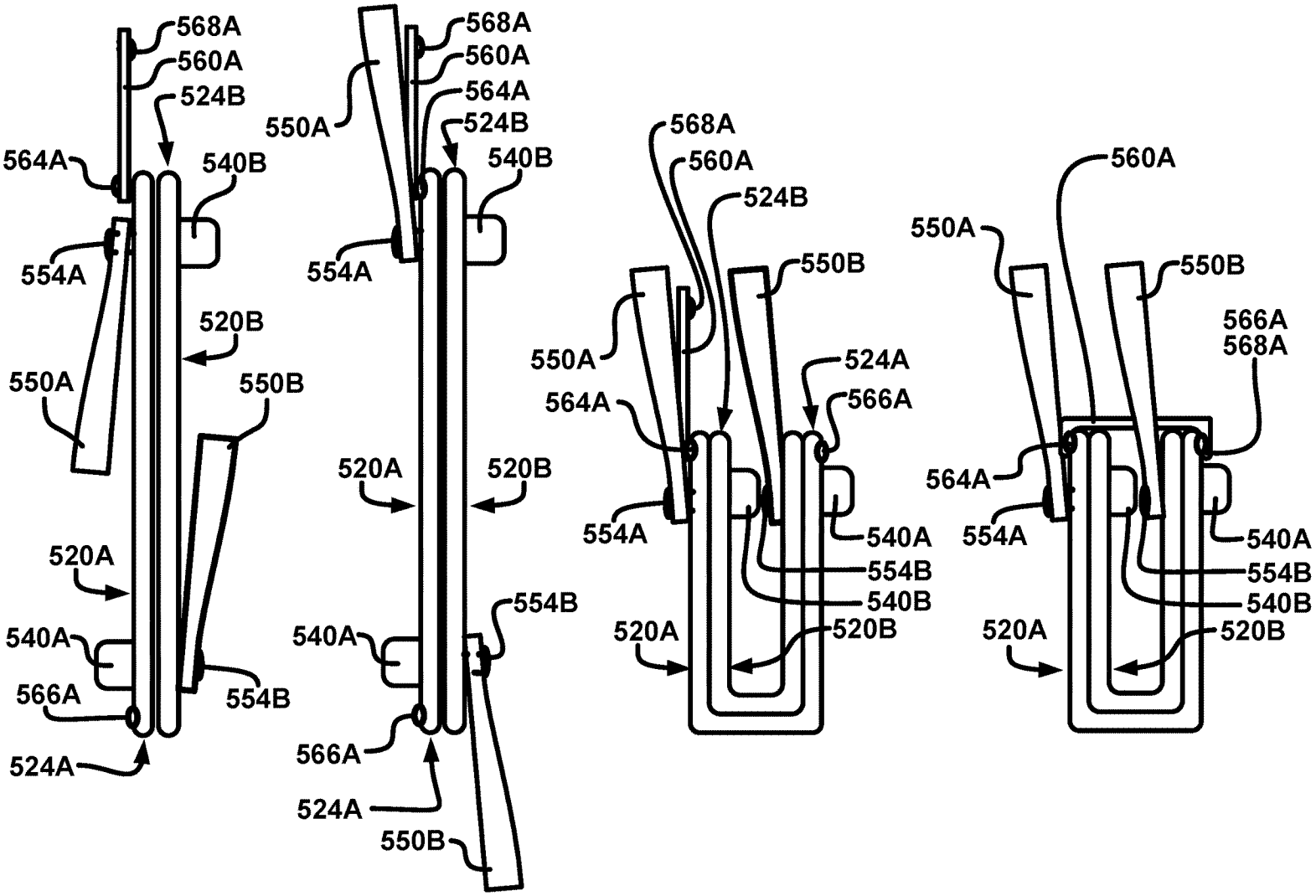
FIG. 5A is an illustration of a side view of a first footwear and a second footwear where the ground sides of the footwear are touching, where the heel side of the first footwear and the toe side of a second footwear are proximate, and the second strap is rotated in the direction of the heel portion of the first footwear as per an aspect of a disclosed example embodiment.
FIG. 5B is an illustration of a side view of a first footwear and a second footwear where the ground sides of the footwear are touching and the heel side of the first footwear and the toe side of a second footwear are proximate, and the first and second footwear are rotated in the direction of the heel portion of the footwear as per an aspect of a disclosed example embodiment.
FIG. 5C is an illustration of a side view of a first footwear and a second footwear where the ground sides of the footwear are touching and the heel side of the first footwear and the toe side of a second footwear are proximate, in the folded position without the second strap fastened as per an aspect of a disclosed example embodiment.
FIG. 5D is an illustration of a side view of a first footwear and a second footwear where the ground sides of the footwear are touching and the heel side of the first footwear and the toe side of a second footwear are proximate, in the folded position with the second strap fastened as per an aspect of a disclosed example embodiment.

FIG. 5A is an illustration of a side view for a first footwear (e.g. 111) and a second footwear (e.g. 112) where the ground sides of the footwear are touching, where the heel side (e.g. 326, 226A, 126A) of the first footwear (e.g. 111) and the toe side 524B of a second footwear (e.g. 112) may be proximate, and the second strap 560A may be rotated in the direction of the heel side (e.g. 326, 226A, 126A) of the first footwear (e.g. 111).

According to an embodiment, a first footwear (e.g. 111) may comprise a first strap 550A; second strap 560A; a foot side 520A; a toe loop 540A; a first fastener 566A; a third fastener 568A; a second rotatable connector 554A; a toe side 524A; a third rotatable connector 564A and a first rotatable connector (e.g. 352, 152A). According to an embodiment, a second footwear (e.g. 112) may comprise a foot side 520A; a toe loop 540B; a toe side 524B; a first strap 550B and a second rotatable connector 554B.

According to an embodiment, the first strap 560A may rotate about the third rotatable connector 564A and may point in the direction of the heel side (e.g. 326, 226A, 126A).

FIG. 5B is an illustration of a side view for a first footwear (e.g. 111) and a second footwear (e.g. 112) where the ground sides of the footwear are touching, where the heel side (e.g. 326, 226A, 126A) of the first footwear (e.g. 111) and the toe side 524B of a second footwear (e.g. 112) may be proximate, and the second strap 560A may rotated in the direction of the heel side (e.g. 326, 226A, 126A) of the first footwear (e.g. 111). According to an embodiment the first strap 550A of the first footwear (e.g. 111) and the first strap 550B of the second footwear (e.g. 112) may be rotated in the direction of the heel portion (e.g. 126A and 126B) of the footwear.

According to an embodiment, a first footwear (e.g. 111) may comprise a first strap 550A; second strap 560A; a foot side 520A; a toe loop 540A; a first fastener 566A; a third fastener 568A; a second rotatable connector 554A; a toe side 524A; a third rotatable connector 564A and a first rotatable connector (e.g. 352, 152A). According to an embodiment, a second footwear (e.g. 112) may comprise a foot side 520A; a toe loop 540B; a toe side 524B; a first strap 550B and a second rotatable connector 554B. According to an embodiment, the second strap 560A may rotate about the third rotatable connector 564A.

According to an embodiment, the first strap 550A of the first footwear (e.g. 111) may rotate about the first rotatable connector (e.g. 352, 152A) and the second rotatable connected 554A so that the first strap 550A is pointed in the direction of the heel side (e.g. 326, 226A, 126A). According to an embodiment, the first strap 550B of the second footwear (e.g. 112) may rotate about the first rotatable connector (e.g. 15213, 2528) and the second rotatable connector 5548 so that the first strap 550B is pointed in the direction of the heel side (e.g. 1268).

FIG. 5C is an illustration of a side view for a first footwear (e.g. 111) and a second footwear (e.g. 112) where the ground sides 528A, 5288 of the footwear are touching, where the heel side (e.g. 326, 226A, 126A) of the first footwear (e.g. 111) and the toe side 5248 of a second footwear (e.g. 112) may be proximate. According to an embodiment the footwear may be in the folded position along the fold line (e.g. 499A) of the first footwear (e.g. 111) and the fold line (e.g. 4998) of the second footwear (e.g. 112) without the second strap 560A being fastened to the first fastener 566A.

According to an embodiment, a first footwear (e.g. 111) may comprise a first strap 550A; second strap 560A; a foot side 520A; a toe loop 540A; a first fastener 566A; a third fastener 568A; a second rotatable connector 554A; a toe side 524A; a third rotatable connector 564A and a first rotatable connector (e.g. 352, 152A). According to an embodiment, a second footwear (e.g. 112) may comprise a foot side 520A; a toe loop 540B; a toe side 524B; a first strap 550B and a second rotatable connector 5548. According to an embodiment, the second strap 560A may rotate about the third rotatable connector 564A.

According to an embodiment, the first footwear (e.g. 111) and the second footwear (e.g. 112) may be configured where the ground side (e.g. 328A) of the first footwear (e.g. 111) and the ground side (e.g. 3288) of the second footwear (e.g. 112) are touching. Further, according to an embodiment the first strap 550A of the first footwear (e.g. 111) and the first strap 550B of the second footwear (e.g. 112) may be rotated in the direction of the heel portion (e.g. 126A and 126B) of the footwear. According to an embodiment, the second strap 560A may rotate about the third rotatable connector 564A. According to an embodiment, the first footwear (e.g. 111) and the second footwear (e.g. 112) in the folded position along the fold line (e.g. 499A) of the first footwear (e.g. 111) and the fold line (e.g. 4998) of the second footwear (e.g. 112) to configure the footwear in a way that positions the heel side (e.g. 326, 226A, 126A) of the first footwear (e.g. 111) and the toe side 5248 of the second footwear (e.g. 112) so that they my touch.

FIG. 5D is an illustration of a side view for a first footwear (e.g. 111) and a second footwear (e.g. 112) where the ground sides 528A, 5288 of the footwear are touching, where the heel side (e.g. 326, 226A, 126A) of the first footwear (e.g. 111) and the toe side 5248 of a second footwear (e.g. 112) may be proximate. According to an embodiment, the footwear may be configured in the folded position along the fold line (e.g. 499A) of the first footwear (e.g. 111) and the fold line (e.g. 4998) of the second footwear (e.g. 112) where the second strap 560A is being fastened to the first fastener 566A by the third fastener 568A.

According to an embodiment, a first footwear (e.g. 111) may comprise a first strap 550A; second strap 560A; a foot side 520A; a toe loop 540A; a first fastener 566A; a third fastener 568A; a second rotatable connector 554A; a toe side 524A; a third rotatable connector 564A and a first rotatable connector (e.g. 352, 152A). According to an embodiment, a second footwear (e.g. 112) may comprise a foot side 520A; a toe loop 540B; a toe side 524B; a first strap 550B and a second rotatable connector 5548. According to an embodiment, the first strap 560A may rotate about the third rotatable connector 564A.

According to an embodiment, the first footwear (e.g. 111) and the second footwear (e.g. 112) may be configured where the ground side (e.g. 328A) of the first footwear (e.g. 111) and the ground side of the second footwear (e.g. 112) are touching. Further, according to an embodiment the first strap 550A of the first footwear (e.g. 111) and the first strap 550B of the second footwear (e.g. 112) may be rotated in the direction of the heel portion (e.g. 126A and 126B) of the footwear. According to an embodiment, the second strap 560A may rotate about the third rotatable connector 564A. According to an embodiment, the first footwear (e.g. 111) and the second footwear (e.g. 112) in the folded position along the fold line (e.g. 499A) of the first footwear (e.g. 111) and the fold line (e.g. 4998) of the second footwear (e.g. 112) to configure the footwear in a way that positions the heel side (e.g. 326, 226A, 126A) of the first footwear and the toe side 5248 of the second footwear (e.g. 112) so that they my touch. According to an embodiment, the third fastener 568A on the second strap 560A may be configured to fasten on the first fastener 566A.

In this disclosure, "a" and "an" and similar phrases are to be interpreted as "at least one" or "one or more." Similarly, any term that ends with the suffix "(s)" is to be interpreted as "at least one" or "one or more." In this disclosure, the term "may" is to be interpreted as "may, for example." In other words, the term "may" is indicative that the phrase following the term "may" is an example of one of a multitude of suitable possibilities that may, or may not, be employed to one or more of the various embodiments. The phrase "in response to" is indicative that the phrase following the phrase "in response to" is an example of one of a multitude of suitable possibilities that may, or may not, be employed to one or more of the various embodiments. The term "comprising" should be interpreted as meaning "including, but not limited to."

In this disclosure, various embodiments are disclosed. Limitations, features, and/or elements from the disclosed example embodiments may be combined to create further embodiments within the scope of the disclosure.

Furthermore, many features presented above are described as being optional through the use of "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

While various embodiments have been described above, it should be understood that they have been presented by way of example, and not limitation. It will be apparent to persons skilled in the relevant art(s) that various changes in form and detail can be made therein without departing from the scope. In fact, after reading the above description, it will be apparent to one skilled in the relevant art(s) how to implement alternative embodiments. Thus, the present embodiments should not be limited by any of the above described exemplary embodiments.

In addition, it should be understood that any figures which highlight the functionality and advantages, are presented for example purposes only. The disclosed architecture is sufficiently flexible and configurable, such that it may be utilized in ways other than that shown. For example, the actions listed in any flowchart may be re-ordered or only optionally used in some embodiments.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112. Claims that do not expressly include the phrase "means for" or "step for" are not to be interpreted under 35 U.S.C. 112.

The invention claimed is:

1. An apparatus comprising:
a first footwear comprising:
a first strap comprising:
a first connector affixing the first strap to a heel end of a foot side of the first footwear;
the first strap extending rearward of the heel end; and
a first fastener disposed to the first strap; and
a second fastener affixed to the first footwear; and
wherein the first footwear and a second footwear are configured such that:
the first footwear and the second footwear can fold together with the first footwear on the outside; and
the first strap is repositionable to connect the first fastener to the second fastener.

2. The apparatus according to claim 1, wherein at least one of the first footwear and second footwear further comprise a second strap affixed to:
a lateral heel portion with a second connector; and
a medial heel portion with a third connector.

3. The apparatus according to claim 2, wherein the second strap comprises a buckle.

4. The apparatus according to claim 2, wherein the second strap comprises hook & loop fasteners.

5. The apparatus according to claim 2, wherein at least one of the second connector and third connector are rotatable.

6. The apparatus according to claim 5, wherein the second strap is configured to rotate about:
the second connector; and
the third connector.

7. The apparatus according to claim 1, further comprising a toe loop affixed to at least one of the first footwear and the second footwear.

8. The apparatus according to claim 7, wherein the toe loop is affixed in proximity to:
a toe medial portion.

9. The apparatus according to claim 1, wherein:

the first fastener and the second fastener are reusable and detachable such that:

the first fastener disconnects from the second fastener;

the first footwear and the second footwear unfold; and the first footwear and the second footwear separate.

10. The apparatus according to claim 1, wherein:

the first connector is rotatable;

the first footwear further comprises a third fastener; and the first footwear is further configured such that:

the first strap rotates about the first connector; and the first fastener connects to the third fastener.

11. The apparatus according to claim 1, further comprising a pocket affixed to the foot side of at least one of the first footwear and the second footwear.

12. The apparatus according to claim 1, wherein at least one of the first footwear and the second footwear is a shoe.

13. The apparatus according to claim 1, wherein at least one of the first footwear and the second footwear is a sandal.

14. The apparatus according to claim 1, wherein at least one of the first footwear and the second footwear is a flip-flop.

15. The apparatus according to claim 1, wherein at least one of the first footwear and the second footwear comprise wool.

16. The apparatus according to claim 1, wherein the fasteners comprise magnets.

17. The apparatus according to claim 1, wherein the fasteners comprise snaps.

18. The apparatus according to claim 1, wherein the fasteners comprise hook & loop fasteners.

19. The apparatus according to claim 1, wherein the second fastener is disposed on a toe end.

20. The apparatus according to claim 1, wherein the length of the first strap is less than the distance from the first connector to the second fastener when the first footwear is not folded.

* * * * *